US008770171B2

(12) United States Patent
Paa

(10) Patent No.: US 8,770,171 B2
(45) Date of Patent: Jul. 8, 2014

(54) COMBUSTION ENGINE, DIAGNOSTIC ARRANGEMENT FOR A COMBUSTION ENGINE AND A METHOD FOR SETTING A COMBUSTION ENGINE

(75) Inventor: Andreas Paa, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 366 days.

(21) Appl. No.: 13/352,035

(22) Filed: Jan. 17, 2012

(65) Prior Publication Data

US 2012/0180758 A1 Jul. 19, 2012

(30) Foreign Application Priority Data

Jan. 17, 2011 (DE) ..... 10 2011 008 737

(51) Int. Cl.
*F02D 41/16* (2006.01)
*F02D 41/22* (2006.01)

(52) U.S. Cl.
USPC ..... 123/339.15; 701/107

(58) Field of Classification Search
USPC ..... 123/349, 350, 399, 436, 679, 680, 687, 123/339.1, 339.15, 198 D; 701/103, 107, 701/110
See application file for complete search history.

(56) References Cited

U.S. PATENT DOCUMENTS 5,056,483 A * 10/1991 Ohuchi ..... 123/339.15

* cited by examiner

*Primary Examiner* — Hai Huynh
(74) *Attorney, Agent, or Firm* — Walter Ottesen P.A.

(57) ABSTRACT

A combustion engine has a fuel supply unit, an ignition unit and a controller controlling the amount of fuel and the ignition time. An adjustable throttle element controlling the amount of combustion air to the engine and an adjustable idling stop for the throttle element are provided. The controller includes a regulating unit regulating the rotational speed of the motor to a set-point rotational speed ($n_{soll}$) when idling. To adjust the idling stop, the regulating unit is switched off when idling. A diagnostic unit switches off the regulating unit. A method for adjusting a combustion engines provides that the regulating unit is switched off, the amount of fuel supplied is adjusted during idling and a rotational speed is evaluated, and that on the basis of the rotational speed value, it is determined how the idling stop is to be adjusted to reach a set-point rotational speed maximum ($n_{sollmax}$).

14 Claims, 2 Drawing Sheets

COMBUSTION ENGINE, DIAGNOSTIC ARRANGEMENT FOR A COMBUSTION ENGINE AND A METHOD FOR SETTING A COMBUSTION ENGINE

CROSS REFERENCE TO RELATED APPLICATION

This application claims priority of German patent application no. 10 2011 008 737.0, filed Jan. 17, 2011, the entire content of which is incorporated herein by reference.

FIELD OF THE INVENTION

The invention relates to a combustion engine, to a diagnostic arrangement for a combustion engine, and to a method for setting a combustion engine.

BACKGROUND OF THE INVENTION

It is known to control or regulate the ignition time and the amount of fuel supplied in combustion engines. The amount of combustion air supplied is typically added via a throttle element which is arranged in the intake channel and is activated by the operator via a throttle lever or is actuated by an actuator. During idling, the rotational speed of the engine is regulated to a set-point rotational speed. The set-point rotational speed can in this case be constant or vary in dependence on the temperature and/or air pressure.

Typically provided for the throttle element is an idling stop, which is settable and is set, for example, during the manufacture of the engine or during servicing. Setting takes place, for example, in the case of carburetors, in which the fuel is drawn in in dependence on the negative pressure in the intake channel, in such a manner that the idling adjusting screw is adjusted until the maximum rotational speed is reached and is adjusted from the rotational speed maximum by a predetermined amount in a predetermined direction. As a result, a defined operating point of the combustion engine is achieved. In the case of combustion engines, in which the rotational speed is regulated by the regulating unit to a fixed set-point rotational speed during idling, the rotational speed remains for the most part constant when adjusting the idling stop so that it is not possible to set the idling stop above a rotational speed maximum.

SUMMARY OF THE INVENTION

It is the object of the invention to provide a combustion engine of the type described above wherein the idling stop can be easily set. Furthermore, a diagnostic arrangement for the combustion engine and also a method for setting the combustion engine are described.

The combustion engine of the invention includes: a fuel supply unit configured to supply fuel; an ignition unit; a controller configured to control the amount (x) of fuel supplied and the ignition time point; an adjustable throttle element configured to control the amount of combustion air supplied to the combustion engine; an adjustable idling stop configured for the throttle element; the controller having a closed-loop control unit which is configured to regulate the rotational speed (n) of the combustion engine to a set-point rotational speed ($n_{soll}$) during idling; and, a switch-off device for switching off the closed-loop control unit during idling.

The diagnostic arrangement of the invention is for a combustion engine having a fuel supply unit; an ignition unit; a controller configured to control the amount (x) of fuel supplied and the ignition time point; an adjustable throttle element configured to control the amount of combustion air supplied to the combustion engine; an adjustable idling stop configured for the throttle element; and, the controller having a closed-loop control unit which is configured to regulate the rotational speed (n) of the combustion engine to a set-point rotational speed ($n_{soll}$) while idling. The diagnostic arrangement includes: a diagnostic unit; the closed-loop control unit being configured to be switchable into an off state during idling; and, the diagnostic unit including a device for switching off the closed-loop control unit.

The method of the invention is for setting a combustion engine including a fuel supply unit; an ignition unit; a controller configured to control the amount (x) of fuel supplied and the ignition time point; an adjustable throttle element configured to control the amount of combustion air supplied to the combustion engine; an adjustable idling stop configured for the throttle element; and, the controller having a closed-loop control unit which is configured to regulate the rotational speed (n) of the combustion engine to a set-point rotational speed ($n_{soll}$) while idling. The method includes the steps of: switching off the closed-loop control unit during idling of the combustion engine; changing the amount (x) of fuel supplied to the combustion engine; evaluating a rotational speed value; determining how the idling stop is to be adjusted to achieve a set-point rotational speed maximum ($n_{sollmax}$) on the basis of the rotational speed value; and, again switching on the closed-loop control unit.

Because the regulating unit can be switched off, the idling stop can, as accustomed, be set by adjusting the idling stop and determining the rotational speed maximum which results from the adjustment. After setting, the regulating unit can be switched on again so that the desired constant idling rotational speed results during operation. The regulating unit which can be switched off can also be advantageous for other settings or to determine operating values. For example, the regulating unit which can be switched off is advantageous for determining the engaging speed of a tool driven by the combustion engine.

The terms "control" and "controller" are used as generic terms for control and regulation or controller and regulator. Thus, a regulation of the ignition time can also be provided and the controller can also be a regulator. The regulating unit can also be a control unit.

A simple configuration results when the regulating unit can be switched off electronically via the controller of the combustion engine. In order to ensure that no unintended switching off of the regulating unit occurs during operation, it is, in particular, provided that the combustion engine has a connection for a diagnostic unit and that the regulating unit can be switched off via the connection for the diagnostic unit. As a result, it can be ensured that it is only possible in service to switch off the regulating unit for idling with a corresponding diagnostic unit. A simple configuration without additional plugs or connections is achieved when the combustion engine has a spark plug and the connection for the diagnostic unit is a spark plug connector of the spark plug. The diagnostic unit can be looped into the connection of the spark plug and spark plug connector and thus be electrically connected with the controller of the combustion engine. It can, however, also be provided for the combustion engine to have a switch for switching off the regulating unit. Switching off via a predetermined sequence of operating steps can also be advantageous. As a result, the function of a switch can be fulfilled by operating elements which are present such as a stop switch, a start unit or the like, and so no additional operating elements are required.

For a diagnostic unit for a combustion engine, it is provided that the diagnostic unit has means for switching off the regulating unit. The means for switching off are accordingly not provided in the combustion engine itself, for example in the controller, but are provided in the diagnostic unit. The regulating unit can, in this case, in particular, be switched off electronically.

Advantageously the diagnostic unit has means for changing the amount of fuel supplied to the combustion engine, means for sensing the rotational speed of the combustion engine and/or a display unit for displaying the required adjustment of the idling stop. The diagnostic unit can as a result determine how the idling stop is to be adjusted and display the same to the operator for simple operation. During the manufacture of the combustion engine, it can be provided that the idling stop is adjusted automatically via a corresponding adjusting unit.

For a method for setting a combustion engine, it is provided that initially the regulating unit is switched off, then, during idling, the amount of fuel supplied is changed and the rotational speed value is evaluated, and that on the basis of the rotational speed value, it is established how the idling stop is to be adjusted to achieve a set-point rotational speed maximum. Subsequently the regulating unit is switched on again. As a result, the idling stop can be set in a simple manner. In particular, the rotational speed value is a rotational speed maximum of the rotational speed of the combustion engine, wherein the rotational speed maximum is compared with a set-point rotational speed maximum and on the basis of the rotational speed difference between the rotational speed maximum and the set-point rotational speed maximum it is determined how the idling stop is to be set to achieve the set-point rotational speed. The amount of fuel supplied is in this case, in particular, reduced until the rotational speed maximum is exceeded, that is, the amount of fuel/air mixture supplied to the combustion engine is thus leaned until the rotational speed maximum is exceeded. Depending on the pre-adjustment of the combustion engine, the combustion engine can stall without reaching the rotational speed maximum. When the combustion engine stalls before a rotational speed maximum is reached, it is provided for it to be determined at which amount of fuel supplied the combustion engine stalls. On the basis of the amount of fuel supplied when the engine stalls, it is then determined how the idling stop is to be adjusted.

In particular, a diagnostic unit which evaluates the rotational speed value and displays the value determined for adjusting the idling stop is used for setting the combustion engine. The value for evaluating the rotational speed and the value for the adjustment of the idling stop in dependence on the rotational speed value must, in this case, not be stored in the controller itself but rather can be stored in the diagnostic unit so that the amount of storage space in the controller can be reduced.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
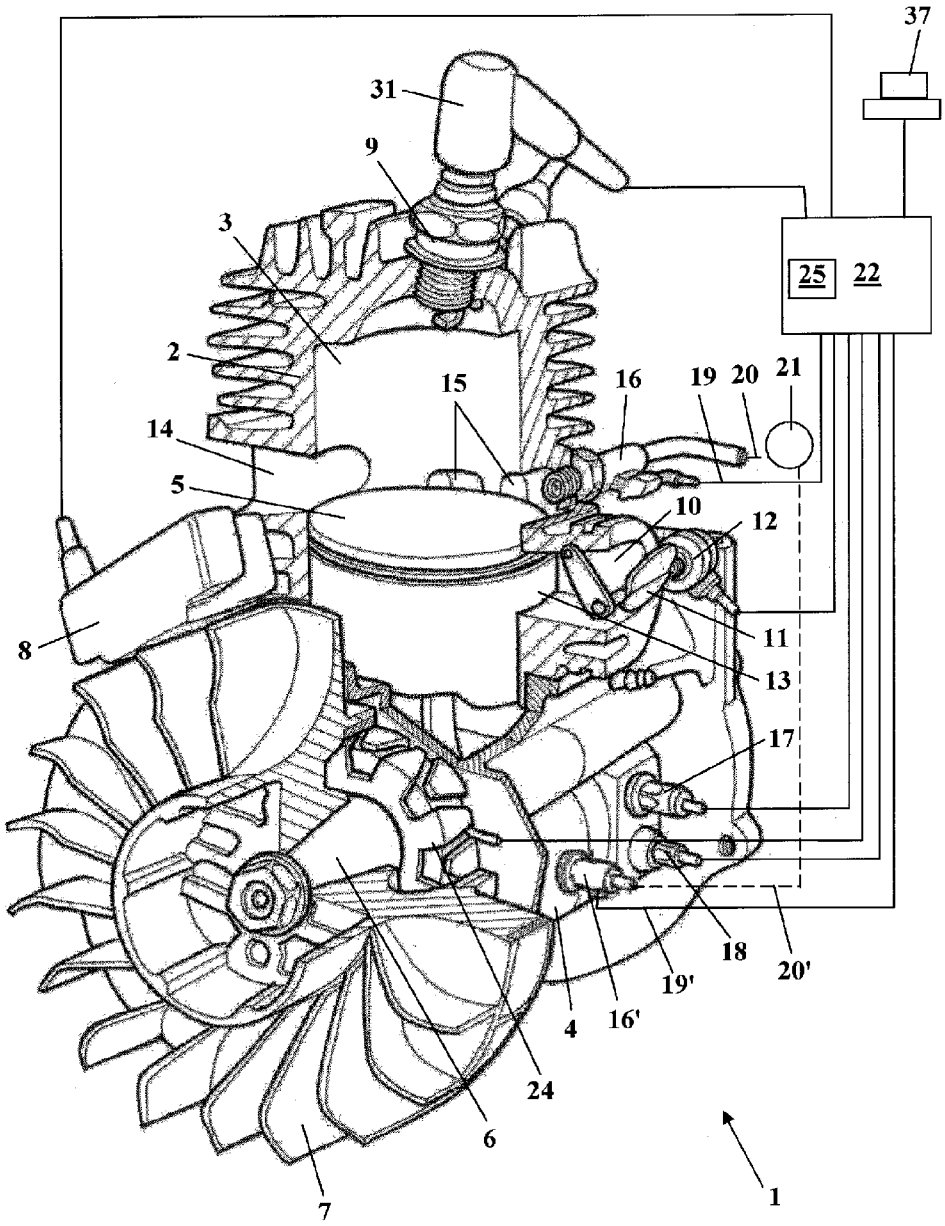
FIG. 1 shows a schematic of a combustion engine.

FIG. 1 shows a two-stroke engine 1 as an exemplary embodiment of a combustion engine. The two-stroke engine 1 has a cylinder 2 in which a combustion chamber 3 is formed. A piston 5, which rotatably drives a crankshaft 6 rotatably mounted in a crankcase 4, is mounted in the cylinder 2 in a reciprocating manner. The piston 5 delimits the combustion chamber 3. An intake channel 10, in which a throttle flap 11 is pivotably mounted as a throttle element, opens at the cylinder bore. A throttle flap sensor 12 can be provided to determine the position of the throttle flap 11. The throttle flap 11 can, for example, be activated via an accelerator cable. The intake channel 10 opens by way of an inlet 13 at the cylinder bore. An outlet 14 leads out of the combustion chamber 3. The inlet 13 and the outlet 14 are slot controlled by the piston 5. The crankcase 4 is connected to the combustion chamber 3 via a plurality of transfer channels 15 in the region of the bottom dead center of the piston 5. A fuel valve 16, via which fuel is supplied to the combustion air drawn in via the intake channel 10, is arranged in one of the transfer channels 15. Alternatively or in addition to the fuel valve 16, a fuel valve 16' can be arranged at the crankcase 4. The fuel valve (16, 16') is connected to a fuel tank 21 via a fuel line (20, 20'). The fuel valve (16, 16') is furthermore connected to a controller 22 of the two-stroke engine 1 via a control line (19, 19').

A pressure sensor 17 and a temperature sensor 18, which are likewise in each case connected to the controller 22, are also arranged on the crankcase 4. The throttle flap sensor 12 is also connected to the controller 22. A spark plug 9, on which a spark plug connector 31 is plugged, projects into the combustion chamber 3. The spark plug connector 31 is connected to the controller 22. The controller 22 controls the ignition time and the amount (x) of fuel supplied.

A fan wheel 7 is fixed on the crankshaft 6 in such a manner so as to rotate therewith. An ignition unit 8, which is likewise connected to the controller 22, is arranged on the outer circumference of the fan wheel 7. The controller 22 can also be integrated into the ignition unit 8. Furthermore, a generator 24 is arranged on the crankshaft 6. The generator 24 can be provided as an alternative or in addition to the ignition unit 8. The generator 24 is also connected to the controller 22. The generator 24 serves to generate power for the controller 22 and the fuel valve (16, 16'), which can be configured as an electromagnetic valve, and also for further electrical components, which may be present, of the two-stroke engine 1. The two-stroke engine 1 serves, in particular, to drive a tool of a handheld work apparatus such as a chain saw, a cut-off machine or the like. The generator 24 can also provide further electrical components of the work apparatus with power.

The controller 22 determines the rotational speed of the crankshaft 6 from the signal from the generator 24 or the signal from the ignition unit 8. When idling, that is, when the throttle flap 11 is for the most part closed, the rotational speed of the two-stroke engine 1 is regulated to a set-point rotational speed $n_{soll}$. The set-point rotational speed $n_{soll}$ can be constant or vary in dependence on temperature, ambient air pressure or the like. In order to regulate the rotational speed, the controller 22 has a regulating unit 25 for idling. The regulating unit 25 can be, for example, a program code stored in the controller 22. As also shown in FIG. 1, a switch 37 is provided via which the regulating unit 25 can be switched on and off while idling, that is, can be activated and deactivated.

Figure 2:
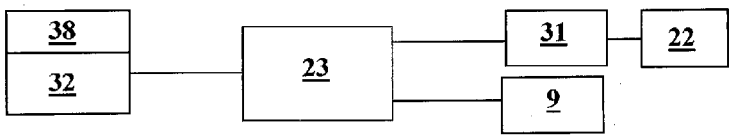
FIG. 2 shows a schematic of the connection of the diagnostic unit to the combustion engine.

For diagnosing, for example in the case of maintenance and repair, a diagnostic unit 23 can be connected to the spark plug connector 31, as is shown schematically in FIG. 2. The diagnostic unit 23 is also connected to the spark plug 9, so that it is possible to operate the combustion engine 1 with the diagnostic unit 23 connected. The diagnostic unit 23 is connected to the controller 22 via the spark plug connector 31 and can communicate therewith. The diagnostic unit 23 can communicate, for example, with the controller 22 and prepare the data provided by the controller 22 and transmit the data to a PC 32. The PC 32 has a monitor 38. The PC 32 represents with the diagnostic unit 23 a diagnostic device for the two-stroke engine 1. A different evaluation and display apparatus can be provided instead of the PC 32. It is also possible for the evaluation and display to take place in the diagnostic unit 23 itself.

Figure 3:
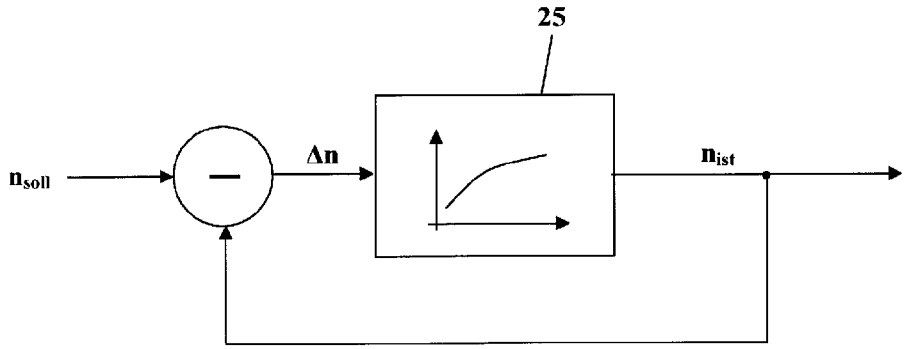
FIG. 3 shows a diagram which illustrates the function of the regulating unit.

FIG. 3 illustrates the function of the regulating unit 25. The input variable of the regulating unit 25 is the rotational speed difference $\Delta n$ of the set-point rotational speed $n_{soll}$ and the actual rotational speed $n_{ist}$. In dependence on the rotational speed difference $\Delta n$, the regulating unit 25 changes the ignition time of the two-stroke engine 1 on the basis of predetermined values, curves or the like, which are indicated by a schematic diagram in FIG. 3. As a result, the rotational speed is changed. Changes in the amount of fuel supplied and/or the position of the throttle flap 11 are compensated as a result, and so no noticeable change in the rotational speed results from a change in the amount of fuel supplied and/or a change in the position of the throttle flap 11 within regulation limits when the regulating unit 25 is switched on. This regulation only ends when the operator wishes to leave idling, that is, for example when the throttle flap 11 is opened. A corresponding signal of the throttle flap sensor 12 can be evaluated by the controller 22, and so the regulating unit 25 is only active when idling. Other controllers or regulators can be provided outside of idling.

Figure 4:
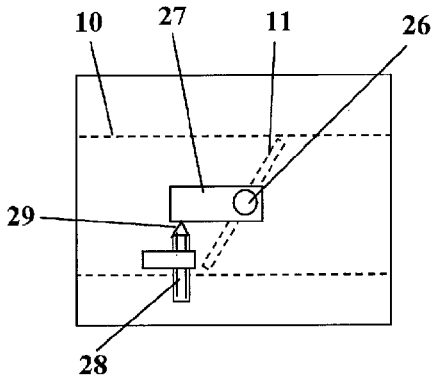
FIG. 4 shows a schematic side view of the intake channel of the combustion engine with a throttle element arranged therein.

The idling stop 29 shown schematically in FIG. 4 is provided for the setting of the position of the throttle flap 11 when idling. In the exemplary embodiment, the idling stop 29 is formed on an adjusting screw 28 on which a throttle lever 27, which is arranged on the throttle shaft 26 in a rotatably fixed manner, rests. The throttle flap 11 is arranged on the throttle shaft 26 in a rotatably fixed manner, so that by screwing in or screwing out the adjusting screw 28 the position of the throttle flap 11 can be changed within predetermined limits when idling.

The idling stop 29 is typically set during manufacture of the two-stroke engine 1 and during repair or maintenance. This is done by adjusting the adjusting screw 28 until a rotational speed maximum is exceeded. Starting from this rotational speed maximum, the adjusting screw 28 is adjusted by a defined amount.

Figure 5:
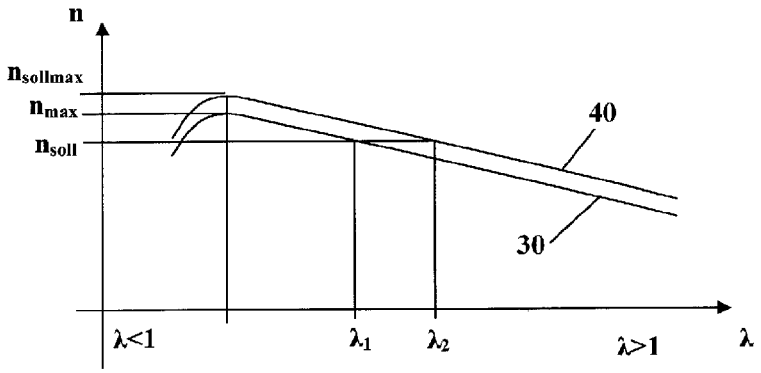
FIG. 5 is a diagram which shows the course of the rotational speed over the amount of fuel supplied; and, FIG. 6 is a flowchart of the method for setting the idling stop.

FIG. 5 schematically shows a diagram, which gives the rotational speed (n) over the air ratio $\lambda$ in the form of a curve. When the mixture is being leaned, the rotational speed initially increases up to the rotational speed maximum $n_{max}$ and subsequently drops again. The desired operating point when idling lies at a set-point rotational speed $n_{soll}$ and an air ratio $\lambda_2$. When the idling stop 29 is set so that the curve 30 results, then the set-point rotational speed $n_{soll}$ is, however, reached at an air ratio $\lambda_1$. In order to reach the desired operating point at the air ratio $\lambda_2$, the idling stop 29 must be adjusted in such a manner that the curve 40 results. Through a corresponding adjustment of the idling stop 29, the curve 30 can be shifted to curve 40. In the process, the rotational speed maximum $n_{max}$ is shifted to a set-point rotational speed maximum $n_{sollmax}$. When the regulating unit 25 regulates the idling rotational speed to the rotational speed $n_{soll}$ during operation, the desired air ratio $\lambda_2$ results as a result of the adjustment of the idling stop 29 and thus the shifting of the curve 30 to the curve 40.

Figure 6:
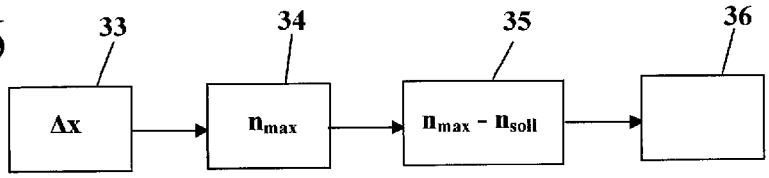

In order to enable a corresponding setting of the idling stop 29 in the case of a two-stroke engine 1 having a regulating unit 25 for idling, the regulating unit 25 is initially switched off via the switch 37 or the PC 32 and the diagnostic unit 23. Subsequently, the amount (x) of fuel supplied to the two-stroke engine 1 via the fuel valve (16, 16') is changed, in particular reduced. The mixture is thus leaned. In FIG. 6, this is provided in method step 33. The leaning is carried out via the PC 32 and the diagnostic unit 23, which operate correspondingly on the controller 22 and the fuel valve (16, 16'). The diagnostic unit determines the resulting rotational speed change of the combustion engine 1 from the rotational speed values determined by the generator 24 and/or by the ignition unit 8. The evaluation of the data can be done in the controller 22, in the diagnostic unit 23 and/or in the PC 32. In method step 34, the rotational speed maximum $n_{max}$ is determined from the determined rotational speeds. In method step 35, the difference between the rotational speed maximum $n_{max}$ and the set-point rotational speed maximum $n_{sollmax}$ is calculated. From this difference, the necessary adjustment of the idling stop 29 is determined in method step 36. During the manufacture of the combustion engine, the idling stop 29 can then be automatically adjusted via corresponding adjusting units. In particular during servicing, the adjustment of the idling stop 29 to be done is displayed on the monitor 38 of the PC 32 so that the operator can perform a corresponding adjustment. The display can for example be carried out by displaying the rotational direction and the angle by which the adjusting screw 28 is to be adjusted. The necessary adjustment values for the idling stop 29 can also be documented in written form, for example in the repair instructions, the operating manual or the like. The adjustment values can, for example, be given in dependence on the rotational speed maximum $n_{max}$. In order to set the idling stop 29, the operator must determine the rotational speed maximum $n_{max}$ and look up the required adjustment value. The rotational speed maximum $n_{max}$ can also be displayed by the diagnostic unit 23.

It can also be provided that the regulating unit 25 is switched off via a predetermined operating sequence. As a result, an additional switch 37 can be dispensed with. When the combustion engine is used in a handheld work apparatus having a stop switch and a pull starter, the regulating unit 25 can, for example, be switched off by the stop switch being kept activated and a particular number of starting strokes being executed with the stop switch pressed. Subsequently, the stop switch must be moved into the operating position and the engine started via the pull starter. When the engine then starts up, the regulating unit 25 is deactivated. The regulating unit can be switched on, for example, automatically in that the engine is switched off or the idling region is left. Further operating elements can also be used to switch off the regulating unit. Simultaneous activation of two operating elements, for example two switches, is also possible.

After the idling stop 29 has been adjusted or the necessary adjustment has been displayed, the regulating unit 25 is switched on again, and so a normal, regulated operation of the two-stroke engine 1 is possible.

Depending on the operating point of the two-stroke engine 1, the motor can stall before the rotational speed maximum $n_{max}$ has been reached. In this case, the diagnostic unit determines the required adjustment of the idling stop 29 from the amount (x) of fuel supplied when the two-stroke engine 1 stalls. The determined adjustment is then likewise displayed and the regulating unit 25 is activated again.

It may also be advantageous to shut off the regulating unit while idling in order to determine the engaging rotational speed of a tool connected to the combustion engine via a clutch, for example a saw chain, a cut-off disc or the like. In order to determine the engaging rotational speed, the rotational speed of the combustion engine must be slowly increased. This is, under certain circumstances, not possible with an active regulating unit.

It is understood that the foregoing description is that of the preferred embodiments of the invention and that various changes and modifications may be made thereto without departing from the spirit and scope of the invention as defined in the appended claims.

What is claimed is:

1. A combustion engine comprising:

a fuel supply unit configured to supply fuel;

an ignition unit;

a controller configured to control the amount (x) of fuel supplied and the ignition time point;

an adjustable throttle element configured to control the amount of combustion air supplied to said combustion engine;

an adjustable idling stop configured for said throttle element;

said controller having a closed-loop control unit which is configured to regulate the rotational speed (n) of the combustion engine to a set-point rotational speed ($n_{soll}$) during idling; and, a switch-off device for switching off said closed-loop control unit during idling.

2. The combustion engine of claim 1, wherein said closed-loop control unit can be switched off electronically via said controller.

3. The combustion engine of claim 2 further comprising:

a connection for a diagnostic unit; and, said closed-loop control unit being capable of being switched off via said connection for the diagnostic unit.

4. The combustion engine of claim 3 further comprising:

a spark plug having a spark plug connector; and, said connection for the diagnostic unit being said spark plug socket.

5. The combustion engine of claim 1, wherein said switch-off device for switching off said closed-loop control unit is a switch.

6. A diagnostic arrangement for a combustion engine having a fuel supply unit; an ignition unit; a controller configured to control the amount (x) of fuel supplied and the ignition time point; an adjustable throttle element configured to control the amount of combustion air supplied to the combustion engine; an adjustable idling stop configured for the throttle element; and, the controller having a closed-loop control unit which is configured to regulate the rotational speed (n) of the combustion engine to a set-point rotational speed ($n_{soll}$) while idling; the diagnostic arrangement comprising:

a diagnostic unit;

said closed-loop control unit being configured to be switchable into an off state during idling; and, said diagnostic unit including a device for switching off said closed-loop control unit.

7. The diagnostic arrangement of claim 6 further comprising a device to adjust the amount (x) of fuel supplied to the combustion engine.

8. The diagnostic arrangement of claim 6, wherein said diagnostic unit includes a device configured to capture the rotational speed (n) of the combustion engine.

9. The diagnostic arrangement of claim 6, wherein said diagnostic unit includes a display unit configured to display the required adjustment of the idling stop.

10. A method for setting a combustion engine including a fuel supply unit; an ignition unit; a controller configured to control the amount (x) of fuel supplied and the ignition time point; an adjustable throttle element configured to control the amount of combustion air supplied to the combustion engine; an adjustable idling stop configured for the throttle element; and, the controller having a closed-loop control unit which is configured to regulate the rotational speed (n) of the combustion engine to a set-point rotational speed ($n_{soll}$) while idling; the method comprising the steps of:

switching off the closed-loop control unit during idling of said combustion engine;

changing the amount (x) of fuel supplied to said combustion engine;

evaluating a rotational speed value;

determining how the idling stop is to be adjusted to achieve a set-point rotational speed maximum ($n_{sollmax}$) on the basis of the rotational speed value; and, again switching on the closed-loop control unit.

11. The method of claim 10 further comprising the steps of:

determining a rotational speed maximum ($n_{max}$) of the combustion engine as said rotational speed value;

comparing the rotational speed maximum ($n_{max}$) to said set-point rotational speed maximum ($n_{sollmax}$) and, determining how the idling stop is to be adjusted on the basis of the difference between the rotational speed maximum ($n_{max}$) and the set-point rotational speed maximum ($n_{sollmax}$).

12. The method of claim 11 further comprising the step of decreasing the amount (x) of fuel supplied until the rotational speed maximum ($n_{max}$) is exceeded.

13. The method of claim 10 further comprising the steps of:

when the combustion engine stalls and before a rotational speed maximum is reached, determining at which amount (x) of the fuel supplied, the combustion engine stalls; and, determining how the idling stop is to be adjusted to reach the set-point rotational speed maximum ($n_{max}$) on the basis of the amount (x) of fuel supplied when the combustion engine stalls.

14. The method of claim 10, wherein a diagnostic unit is used to adjust the combustion engine; and, the diagnostic unit evaluates the rotational speed value and displays the determined value for the setting of the idling stop.

* * * * *